US007118251B1

(12) United States Patent
Chambers et al.

(10) Patent No.: US 7,118,251 B1
(45) Date of Patent: Oct. 10, 2006

(54) ILLUMINATION DEVICE FOR SIMULATING CHANNEL LETTERS

(75) Inventors: Joe A. Chambers, Cookeville, TN (US); Mark J. Cleaver, Wilmette, IL (US); John R. Dominick, Cookeville, TN (US); Eric Olav Eriksson, Evanston, IL (US); George R. Hulse, Cookeville, TN (US)

(73) Assignee: iLight Technologies, Inc., Chicago, IL (US)

( * ) Notice: Subject to any disclaimer, the term of this patent is extended or adjusted under 35 U.S.C. 154(b) by 26 days.

(21) Appl. No.: 10/850,743

(22) Filed: May 21, 2004

Related U.S. Application Data

(60) Provisional application No. 60/473,673, filed on May 23, 2003.

(51) Int. Cl.
*F21V 3/04* (2006.01)

(52) U.S. Cl. ..... 362/311; 362/355

(58) Field of Classification Search ..... 40/544; 362/544–545, 219, 223, 225; 359/707, 599, 359/513
See application file for complete search history.

(56) References Cited

U.S. PATENT DOCUMENTS

| | | | | |
|---|---|---|---|---|
| 3,720,827 | A * | 3/1973 | Hemphill | 362/309 |
| 3,830,682 | A * | 8/1974 | Rowland | 428/142 |
| 4,111,520 | A | 9/1978 | Bernal G. | |
| 4,298,869 | A | 11/1981 | Okuno | |
| 4,376,946 | A | 3/1983 | Kaminow et al. | |
| 4,382,272 | A * | 5/1983 | Quella et al. | 362/84 |
| 4,597,033 | A | 6/1986 | Meggs et al. | |
| 4,607,317 | A | 8/1986 | Lin | |
| 4,767,172 | A | 8/1988 | Nichols et al. | |
| 4,785,567 | A | 11/1988 | Consiglio | |
| 4,891,896 | A | 1/1990 | Boren | |
| 4,976,057 | A | 12/1990 | Bianchi | |
| 4,996,632 | A | 2/1991 | Aikens | |
| 5,057,981 | A | 10/1991 | Bowen et al. | |
| 5,151,679 | A | 9/1992 | Dimmick | |
| 5,201,020 | A | 4/1993 | Kannabiran | |
| 5,219,217 | A | 6/1993 | Aikens | |
| 5,301,090 | A | 4/1994 | Hed | |
| 5,303,133 | A | 4/1994 | Wagner | |

(Continued)

FOREIGN PATENT DOCUMENTS

| | | |
|---|---|---|
| JP | 55-97903 | 7/1980 |

(Continued)

*Primary Examiner*—Renee Luebke
*Assistant Examiner*—Robert May
(74) *Attorney, Agent, or Firm*—Stites & Harbison, PLLC; David W. Nagle, Jr.; Mandy W. Decker

(57) ABSTRACT

An illumination device generally comprises a housing, a light source, and a scattering member. The housing includes a base portion and a side wall, which collectively defines an interior cavity with an open end having a predetermined shape. A light source is positioned within the interior cavity, along with an electric connecting member adapted to connect the light source to a remote power source. A scattering member having substantially the same predetermined shape as the open end of the housing is positioned adjacent the light source at the open end of the interior cavity. The scattering member has a light-emitting surface and is composed of a material which causes light entering the scattering member to be directed through a portion of thereof before being scattered and emitted, such that a substantially uniform light pattern is perceived along the light-emitting surface of the scattering member in the predetermined shape.

12 Claims, 6 Drawing Sheets

U.S. PATENT DOCUMENTS 5,365,411 A 11/1994 Rycroft et al.
5,375,043 A 12/1994 Tokunaga
5,387,458 A * 2/1995 Pavelka et al. ..... 428/141
5,410,453 A 4/1995 Ruskouski
5,416,679 A 5/1995 Ruskouski et al.
5,459,955 A 10/1995 Ruskouski et al.
5,475,786 A 12/1995 Nishiguchi et al.
5,497,440 A 3/1996 Croitoru et al.
5,526,236 A 6/1996 Burnes et al.
5,537,297 A 7/1996 Ghandehari
5,588,236 A 12/1996 Suzuki
5,613,751 A 3/1997 Parker et al.
5,618,096 A 4/1997 Parker et al.
5,640,792 A 6/1997 Smith et al.
5,674,622 A * 10/1997 Burns et al. ..... 428/412
5,694,513 A 12/1997 Okaniwa
5,806,957 A * 9/1998 Prior et al. ..... 362/459
5,842,297 A 12/1998 Tung
5,876,107 A 3/1999 Parker et al.
5,879,076 A 3/1999 Cross
5,887,968 A 3/1999 Logan
5,921,652 A 7/1999 Parker et al.
5,934,792 A 8/1999 Camarota
5,950,340 A 9/1999 Woo
5,964,518 A 10/1999 Shen
5,964,981 A 10/1999 Nelson et al.
5,996,263 A 12/1999 Black
6,023,869 A 2/2000 Durbin
6,042,248 A 3/2000 Hannah et al.
6,065,846 A 5/2000 Kato et al.
6,076,294 A 6/2000 Durbin
6,079,838 A 6/2000 Parker et al.
6,095,673 A 8/2000 Goto et al.
6,123,442 A 9/2000 Freier et al.
6,146,006 A 11/2000 Cross
6,158,882 A 12/2000 Bischoff, Jr.
6,183,104 B1 2/2001 Ferrara
6,186,645 B1 2/2001 Camarota
6,193,385 B1 2/2001 Maki et al.
6,204,899 B1 3/2001 Hall
6,217,201 B1 4/2001 Hulse
6,244,734 B1 6/2001 Hulse
6,260,991 B1 7/2001 Hulse
6,283,612 B1 9/2001 Hunter
6,354,714 B1 * 3/2002 Rhodes ..... 362/153.1
6,361,186 B1 3/2002 Slayden
6,394,623 B1 5/2002 Tsui
6,404,131 B1 6/2002 Kawano et al.
6,431,717 B1 8/2002 Anderson et al.
6,488,397 B1 12/2002 Masutani et al.
6,517,224 B1 2/2003 Zakerzewski
6,526,588 B1 * 3/2003 White et al. ..... 2/69
6,582,103 B1 6/2003 Popovich et al.
6,592,238 B1 7/2003 Cleaver et al.
6,612,717 B1 9/2003 Yen
6,631,575 B1 * 10/2003 Voelzke et al. ..... 40/451
6,676,284 B1 1/2004 Wilson
6,761,472 B1 7/2004 Cleaver et al.
6,890,642 B1 * 5/2005 Kaminsky et al. ..... 428/319.3
6,964,507 B1 * 11/2005 Mohacsi ..... 362/545
2003/0123150 A1 * 7/2003 Brickey et al. ..... 359/599

FOREIGN PATENT DOCUMENTS

JP 62-41185 3/1986
JP 61-165583 10/1986
JP 6-12021 1/1994
JP 3007923 12/1994
JP 61-286878 12/1996
JP 200-29406 1/2000
JP 2000-307152 11/2000
WO WO 01/04967 A1 1/2001

* cited by examiner

ILLUMINATION DEVICE FOR SIMULATING CHANNEL LETTERS

CROSS REFERENCES TO RELATED APPLICATIONS

This application claims priority from U.S. Provisional Application Ser. No. 60/473,673 filed May 23, 2003, the entire disclosure of which is incorporated herein by this reference.

FIELD OF THE INVENTION

The present invention relates to illumination devices using high-intensity, low-voltage light-emitting diodes that may be adapted for applications in which common channel letters are used.

BACKGROUND OF THE INVENTION

Channel letters are commonly used to provide signage on buildings, specifically when it is desirable to view the signage at night or from a distance. A common channel letter is constructed of an enclosure that outlines the desired shape, such as the shape of a letter or other alphanumeric character. This enclosure has a substantially flat rear surface for attachment to a building, and more importantly, is designed to house a light source such as an incandescent lamp, fluorescent lighting, or neon lighting. Finally, the front of the enclosure is open and adapted to receive a substantially translucent lens. The lens is commonly tinted and diffuses light emanating from the light source, at least to some extent, and thus provides an illuminated letter or other shape.

The light sources typically used in channel letters, such as fluorescent lighting or neon lighting, provide uniform and bright light typically devoid of hot spots; however, they have a variety of shortcomings. For example, such light sources often have a relatively short life, operate at high voltages, consume large amounts of energy, and/or are fragile. Additionally, with regard to neon lighting, it is both fragile and heavy, primarily due to its supporting infrastructure, making it expensive to package or ship. Moreover, it is extremely awkward to initially handle, install, and/or replace neon lighting.

The recent introduction of lightweight and breakage resistant point light sources, as exemplified by high-intensity light-emitting diodes (LEDs), have shown great promise to those interested in alternate light sources for various illumination devices. LEDs are not only lightweight and resilient, but, when compared to other light sources, have a long life, operate at low voltages, and consume small amounts of energy. Despite these benefits, the attributes of uniformity and brightness have proven to be difficult to produce in illumination devices incorporating LEDs. For example, the lenses often used in channel letters do not sufficiently diffuse the light emanating from each LED to eliminate hot spots. Additionally, LEDs are currently available in only a finite number of colors.

Accordingly, there remains a need in the art for an illumination device for simulating channel letters which satisfactorily addresses these problems.

SUMMARY OF THE INVENTION

The present invention meets the above identified needs, and others, by providing an illumination device for simulating channel letters that emits uniform and bright light devoid of hot spots; incorporates a light source that is lightweight, resilient, and long-lasting; operates at low voltages; consumes small amounts of energy; and can generate light of various colors.

An illumination device made in accordance with the present invention generally comprises a housing, a light source, and a scattering member. The housing defines an interior cavity with an open end, and the light source is positioned within this interior cavity. The light source preferably is a series of point light sources, such as high-intensity LEDs, which are connected to a remote power source by an electric connecting member. Examples of the electric connecting member include: a printed circuit board, a series of electrically connected printed circuit boards, or a flexible electric connecting member forming a continuous strand of point light sources.

The scattering member has a light-receiving surface and a light-emitting surface. The scattering member is positioned with its light-receiving surface adjacent the light source at the open end of the housing. Light entering the scattering member is directed through a portion of the scattering member and then scattered and emitted, with the result being that a substantially uniform light pattern is perceived along the light-emitting surface of the scattering member.

DETAILED DESCRIPTION OF THE INVENTION

The present invention is an illumination device using high-intensity, low-voltage light-emitting diodes that is ideally adapted for applications in which common channel letters are currently used.

Figure 1:
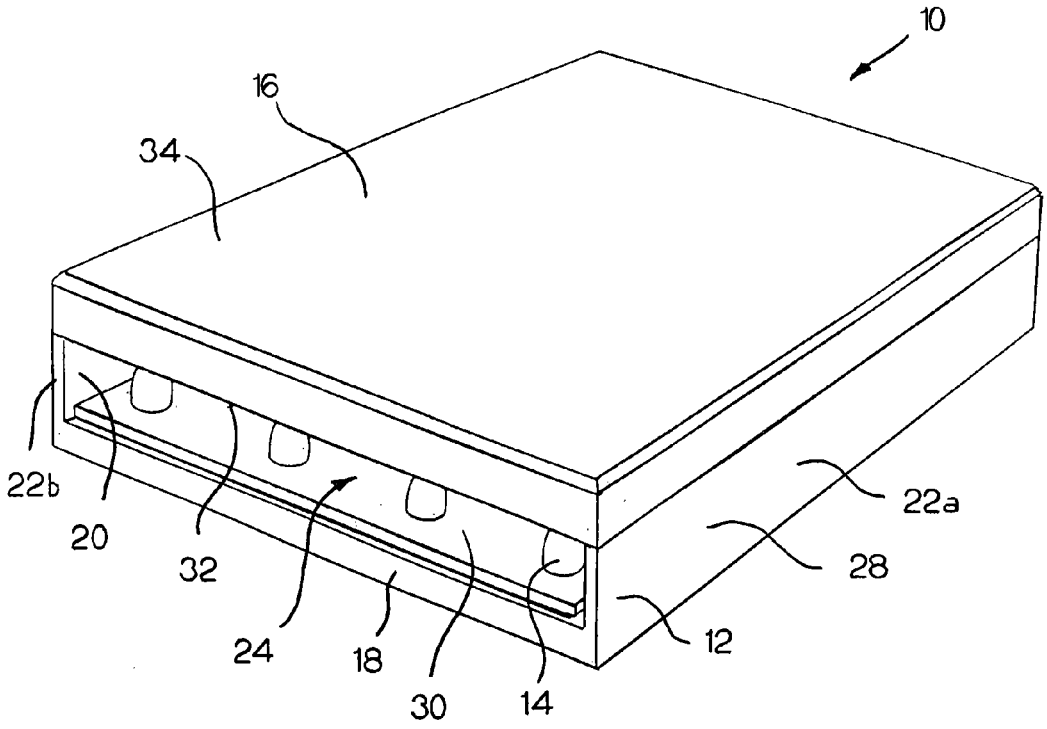
FIG. 1 is a perspective view of an exemplary embodiment of an illumination device made in accordance with the present invention.
Figure 2:
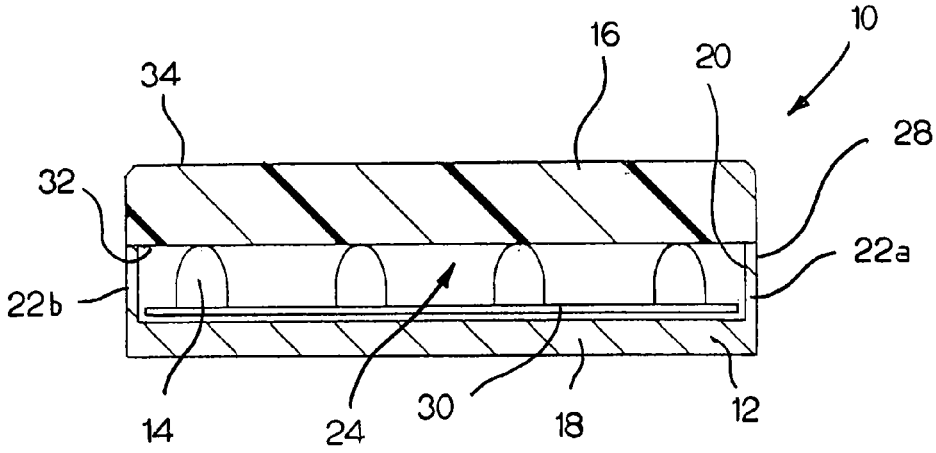
FIG. 2 is an end view of the illumination device of FIG. 1.
Figure 3:
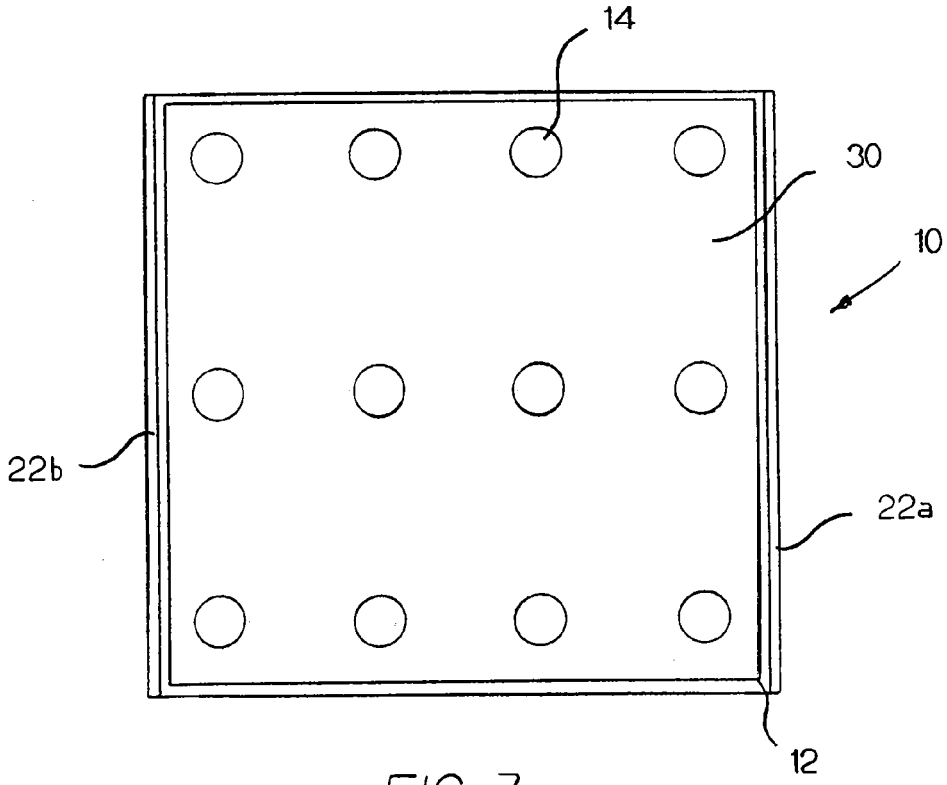
FIG. 3 is a plan view of the illumination device of FIG. 1, with the scattering member removed to illustrate the relative positioning of the point light sources within the interior cavity.

Referring to FIGS. 1–3, an exemplary embodiment of an illumination device 10 made in accordance with the present invention generally comprises a housing 12, a light source 14, and a scattering member 16. The housing 12 includes side walls 22*a*, 22*b* that extend upwardly from a base portion 18 to define an interior cavity 24. As shown in FIGS. 1–3, in this exemplary embodiment, these side walls 22*a*, 22*b* are integral with the base portion 18; however, in alternate embodiments, a separate, continuous side wall may circumscribe the base portion 18 to define the interior cavity 24.

The light source 14 is positioned within the interior cavity 24. In this exemplary embodiment, the light source 14 is comprised of a series of point light sources, such as high-intensity LEDs, which are connected to a remote power source (not shown) by an electric connecting member 30. In this exemplary embodiment and as illustrated in FIGS. 1–3, the electric connecting member 30 is a printed circuit board.

The scattering member 16 has a light-receiving surface 32 and a light-emitting surface 34. The scattering member 16 is positioned with its light-receiving surface 32 substantially adjacent the light source 14 at an open end of the housing 12 defined by the side walls 22*a*, 22*b*. The scattering member 16 is preferably constructed from an acrylic, polyurethane, or similar plastic. Furthermore, to provide for the desired scattering, a filler is incorporated into the acrylic or polyurethane compound. The filler may comprise hollow spheres, called "micro balloons" or "malloons." Such malloons have approximately the same diameter as a human hair, are void in their interior, and preferably have a shell constructed from glass or other material having an index of refraction similar to that of the acrylic, polyurethane, or similar compound into which they are incorporated. Because the indices of refraction essentially match, once the malloons are placed in the acrylic or polyurethane compound, the Fresnel losses at the interfaces are minimal.

When light passes through the scattering member 16, the voids within the respective malloons act as a negative focusing lens, deflecting the light. Thus, light entering the scattering member 16 is directed through a portion of the scattering member 16 and then scattered and emitted as the impregnated malloons deflect the light, with the result being that a substantially uniform light pattern is perceived along the light-emitting surface 34 of the scattering member 16.

The scattering member 16 may be formed into any desired shape; for example, it may have a particular geometric shape or the shape of an alphanumeric character. Nevertheless, it is contemplated that the scattering member 16 have substantially the same shape as the open end defined by the housing 12, not necessarily the shape created by the distributed point light sources 16 held within the housing 12. For example, with reference to FIG. 3, because the housing 12 of the illumination device 10 defines a substantially rectangular open end, the scattering member 16 (shown in FIGS. 1 and 2) of the illumination device 10 would be substantially rectangular. Likewise, with reference to FIG. 4, because the housing 112 of this alternate embodiment of an illumination device 110 defines a substantially rectangular open end, the scattering member (not shown) would be substantially rectangular, notwithstanding the serpentine-like distribution of point light sources 114. For another example, with reference to FIG. 5, if an alternate embodiment of the illumination device 210 has a housing 212 that defines a substantially "C-shaped" open end, the scattering member 216 also is substantially "C-shaped."

In any event, and returning to the exemplary embodiment illustrated in FIGS. 1–3, to improve efficiency and perceived brightness of the illumination device 10, it is preferred that the interior surfaces 20 of the side walls 22*a*, 22*b* be provided with a light-reflecting material, such as a white coating, paint, or tape to collect and direct light emitted from the light source 14 into the scattering member 16. Furthermore, it is preferred that the exterior surfaces 28 of the side walls 22*a*, 22*b* be provided with a light-absorbing material, such as a black coating, paint, or tape to prevent leakage from the illumination device 10 and to prevent the introduction of ambient light into the illumination device 10.

Figure 2A:
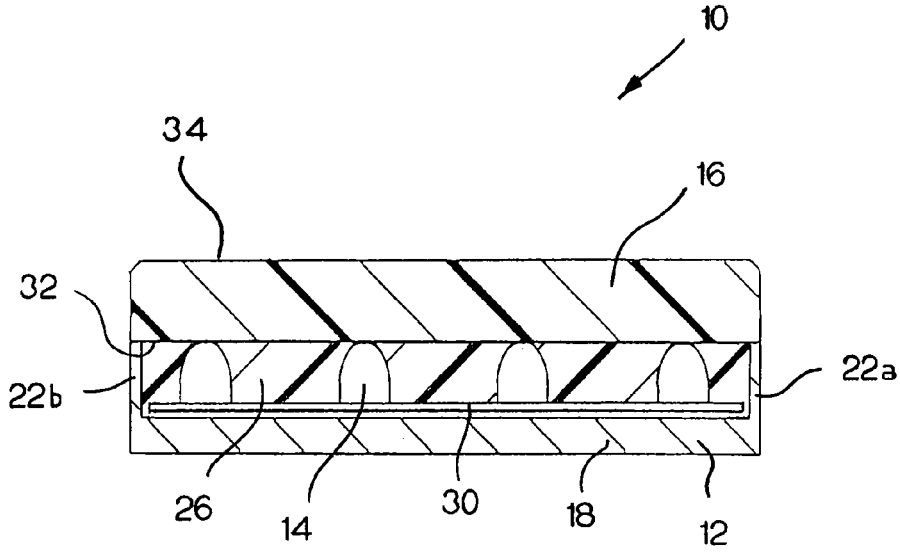
FIG. 2A is an end view of the illumination device of FIG. 2, but with the interior cavity filled with a potting material.

Referring now to FIG. 2A, as a further refinement, the interior cavity 24 defined by the base portion 18 and side walls 22*a*, 22*b* of the housing 12 may be filled with a light-transmitting potting material 26, such as a substantially transparent or clear potting material, which maintains the position of the light sources 16 and associated electric connecting member 30 within and relative to the housing 12.

Figure 4:
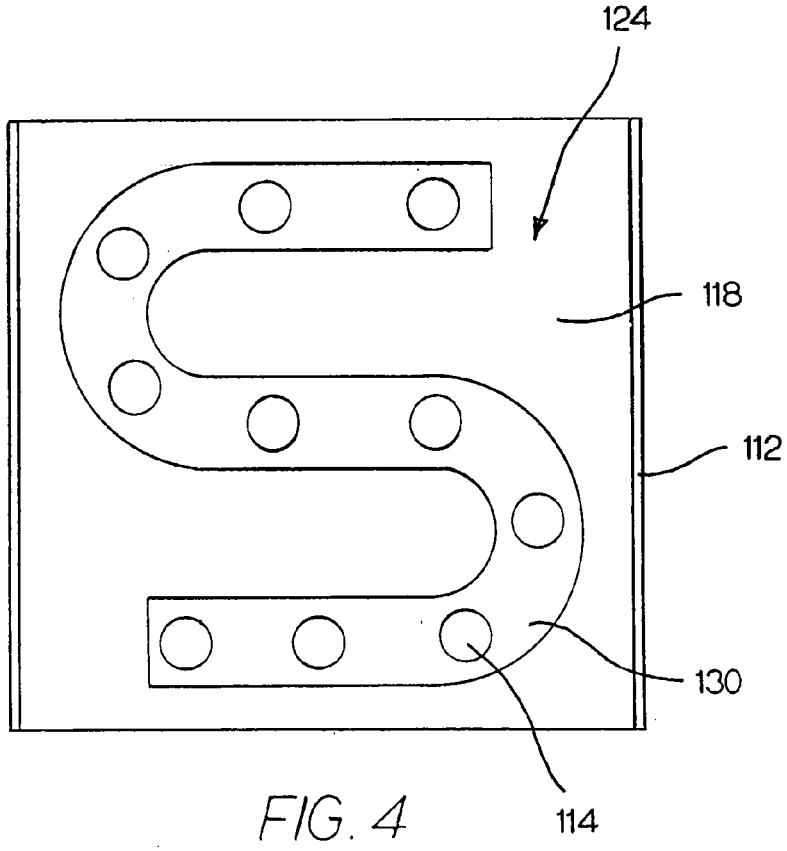
FIG. 4 is a plan view of an alternate embodiment of an illumination device made in accordance with the present invention, again with the scattering member removed to illustrate the relative positioning of the point light sources.
Figure 5:
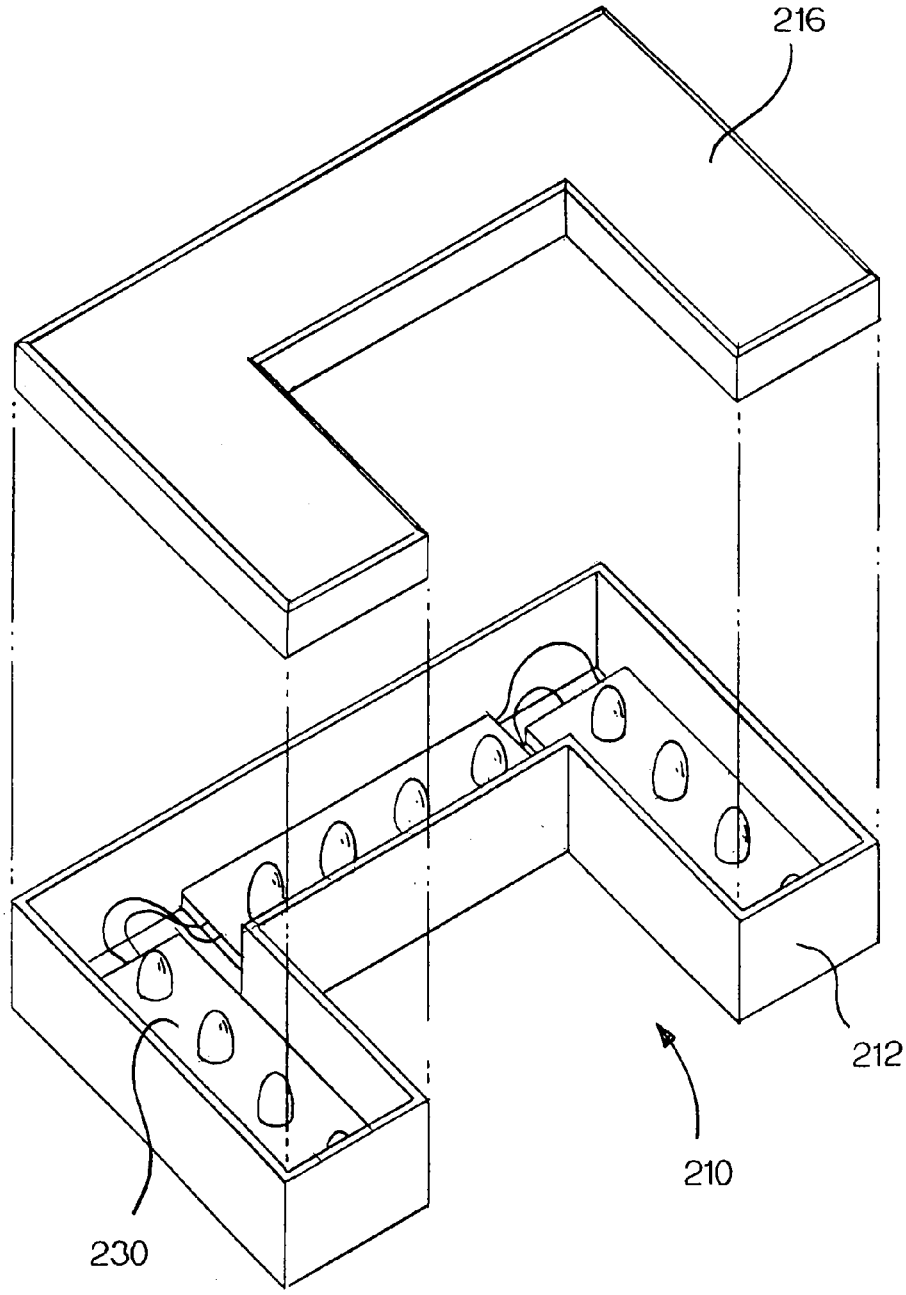
FIG. 5 is an exploded perspective view of another alternate embodiment of an illumination device made in accordance with the present invention.

Referring now to FIG. 4, as yet a further refinement, an illumination device 110 made in accordance with the present invention may have a light source 114 comprised of a series of LEDs attached to a flexible electric connecting member 130 to create a continuous strand, which may be placed in the internal cavity 124 defined by the housing 112 such that the LEDs are substantially evenly distributed beneath the scattering member (not shown). For another example of distributed point light sources, in the alternate embodiment illustrated in FIG. 5, the electric connecting member 230 of the illumination device 210 is a series of electrically connected printed circuit boards which are oriented into a particular configuration, in this case, a C-shaped configuration that matches the shape of the housing 212 and scattering member 216.

Figure 6:
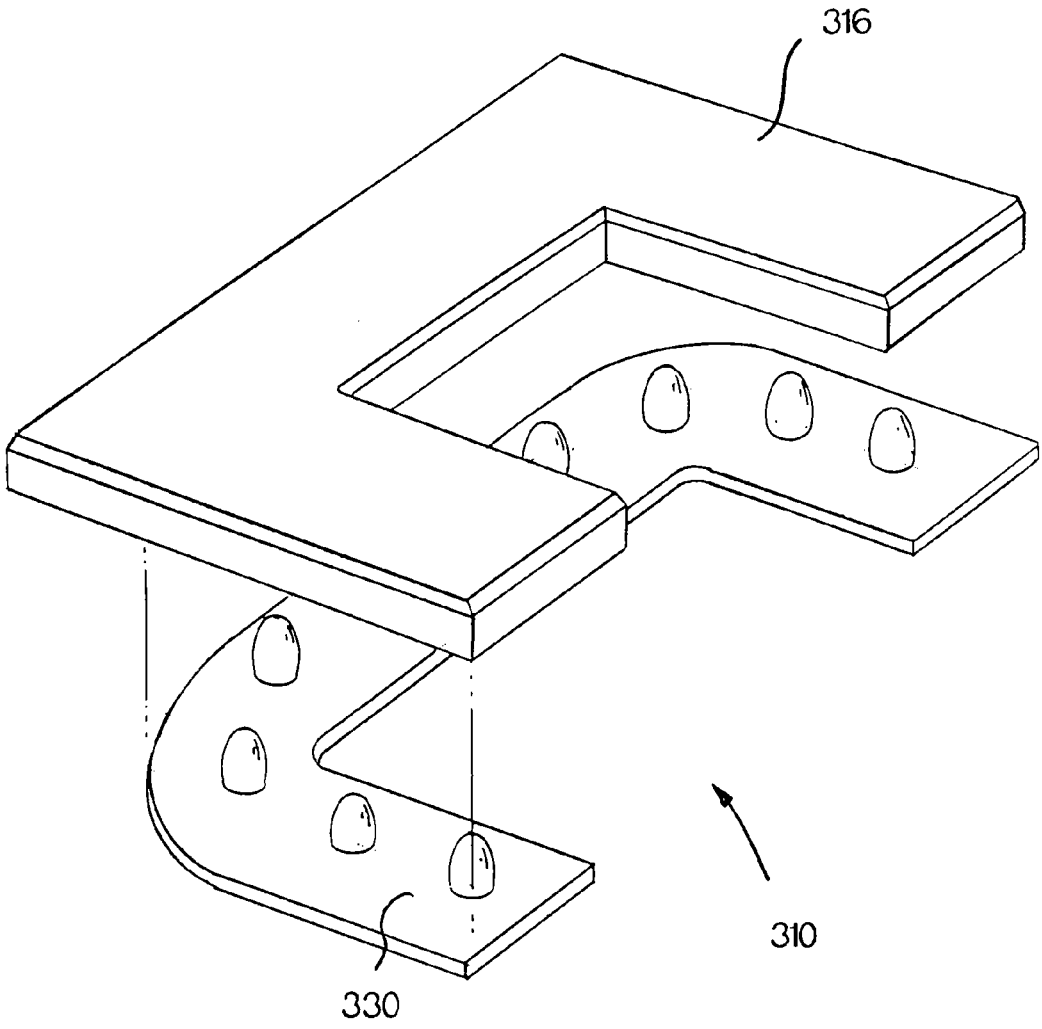
FIG. 6 is an exploded perspective view of the light source and scattering member of an illumination device made in accordance with the present invention, illustrating how the light source and scattering member are positioned relative to one another.

FIG. 6 is an exploded perspective view of the light source and scattering member of an yet another alternate embodiment of illumination device 310 made in accordance with the present invention, illustrating how the electric connecting member 330 could be a unitary member, yet have a variety of shapes, in this case, a C-shape that again matches the shape of the scattering member 316.

Figure 7:
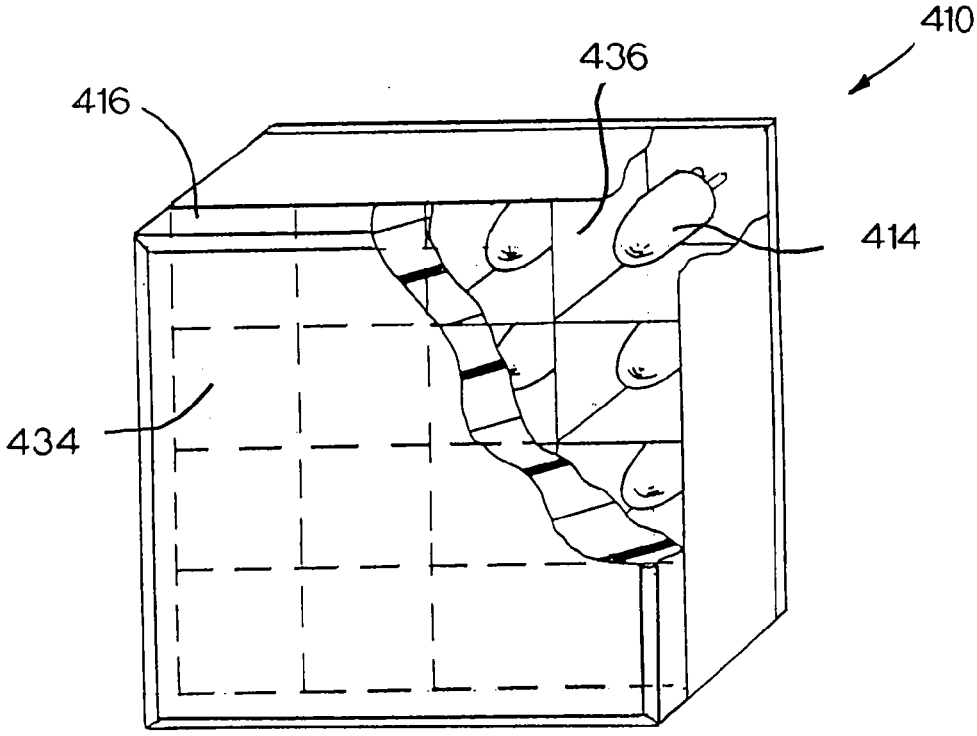
FIG. 7 is a perspective view of another alternate embodiment of an illumination device made in accordance with the present invention, with the scattering member broken away to show the individual collectors associated with the point light sources.

Referring now to FIG. 7, as yet a further refinement, in certain embodiments, to ensure that a substantially uniform light pattern is perceived along the light-emitting surface 434 of the scattering member 416 of the illumination device 410, a plurality of collectors 436 may be provided, each collector 436 being associated with one of the point light sources 414 for directing light emitted from that point light source 414 into the scattering member 416. It is contemplated that the surfaces of these collectors 436 be provided with a light-reflecting material, such as a mirror, white coating, paint, tape.

Figure 8:
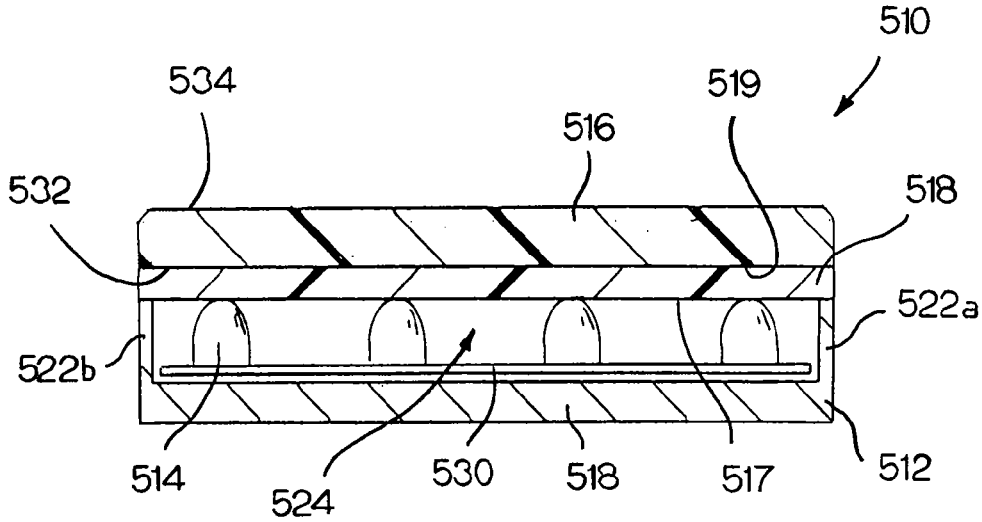
FIG. 8 is an end view of another alternate embodiment of an illumination device made in accordance with the present invention that includes a light color conversion system.

Lastly, as mentioned above, the available visible color spectrum of a device incorporating LEDs as the light source is limited by the finite availability of LED colors. Furthermore, certain LED colors are significantly more expensive than others and/or have life spans that are significantly shorter than others. Thus, as illustrated in FIG. 8, the illumination device 510 is constructed so as to provide for emission of light with a perceived color that is different than that of the light source (i.e., LEDs) itself.

This exemplary illumination device 510 again generally comprises a housing 512, a light source 514 (i.e., a plurality of LEDs), and a scattering member 516. The housing 512 includes side walls 522*a*, 522*b* that extend upwardly from a base portion 518 to define an interior cavity 524. The emission of light with a perceived color that is different than that of the LEDs 514 is accomplished through the incorporation of a light color conversion system into the embodiment 510, specifically an intermediate light-transmitting medium 518 extending between and positioned adjacent the light source 514 and the scattering member 516 with a light-receiving surface 517 for receiving light emitted from the light source 514 and a light-emitting surface 519 for emitting light into the scattering member 516.

As described in co-pending and commonly assigned U.S. patent application Ser. No. 10/455,639 (U.S. Publication No. 2003/0198049), which is incorporated herein by this reference, this intermediate light-transmitting medium 518 may be composed of a matrix of a substantially translucent acrylic or similar material tinted with a predetermined combination of one or more fluorescent dyes. Furthermore, it should be noted that, although the intermediate light-transmitting medium 518 illustrated in FIG. 8 is a unitary member, it may also be comprised of a plurality of discrete layers without departing from the spirit and scope of the present invention. Alternatively, the intermediate light-transmitting medium 518 could comprise one or more layers of paint containing fluorescent dyes applied to the light-receiving surface 532 of the scattering member 516. In any event, the intermediate light-transmitting medium 518 and the fluorescent dyes contained therein thus serve as a fluorescent body. Specifically, because of its position adjacent the light source 514, light emitted from the light source 514 is directed into the intermediate light-transmitting medium 518 and interacts with the fluorescent dyes contained therein. This light is partially absorbed by each of the fluorescent dyes of the intermediate light-transmitting medium 518, and a lower-energy light is then emitted from each of the fluorescent dyes and into the light-receiving surface 532 of the waveguide scattering member 516. Thus, through selection of appropriate combinations of dyes and varying the density of the dyes within the intermediate light-transmitting medium 518, various colors across the visible spectrum may be produced, colors that are ultimately observed along the light-emitting surface 534 of the scattering member 516.

As a further refinement, it is also contemplated that the scattering member itself and/or the light-transmitting potting material (as shown in FIG. 2A) could be tinted with a predetermined combination of one or more fluorescent dyes to create the desired color-changing effect without departing from the spirit and scope of the present invention.

It will be obvious to those skilled in the art that other modifications may be made to the invention as described herein without departing from the spirit and scope of the present invention.

What is claimed is:

1. An illumination device, comprising:

a housing, including a base portion and a side wall, which defines an interior cavity with an open end having a predetermined shape;

a light source positioned within said interior cavity;

an electric connecting member also positioned within said interior cavity and adapted to connect said light source to a remote power source; and a scattering member positioned adjacent said light source at the open end of said interior cavity, said scattering member having substantially the same predetermined shape as the open end of said housing, and said scattering member having a light-emitting surface and being composed of an acrylic compound impregnated with malloons, which causes light entering said scattering member to be directed through a portion of said scattering member and then scattered and emitted, such that a substantially uniform light pattern is perceived along the light-emitting surface of said scattering member in said predetermined shape.

2. The illumination device as recited in claim 1, wherein said light source is a plurality of point light sources.

3. The illumination device as recited in claim 2, wherein said point light sources are light-emitting diodes.

4. The illumination device as recited in claim 2, and further comprising a plurality of collectors, each collector being associated with one of said point light sources for directing light emitted from said point light source into said scattering member.

5. The illumination device as recited in claim 1, wherein an interior surface of said housing is provided with a light-reflecting material.

6. The illumination device as recited in claim 5, wherein an exterior surface of said housing is provided with a light-absorbing material.

7. The illumination device as recited in claim 1, in which a portion of the volume of the interior cavity is filled with a light-transmitting potting material.

8. The illumination device as recited in claim 7, wherein light-transmitting potting material includes one or more light-fluorescing dyes, such that the substantially uniform light pattern perceived along the light-emitting surface of said scattering member has a hue distinct from that of the light source.

9. The illumination device as recited in claim 1, and further comprising an intermediate member generally composed of a matrix of light-transmitting material and one or more light-fluorescing dyes, said intermediate member including a light-receiving surface for receiving light of a predetermined first hue emitted from said light source and a light-emitting surface for emitting light into said scattering member, each of said light-fluorescing dyes emitting light of a predetermined wavelength following absorption of light from said light source, wherein a collective light ultimately emitted from said scattering member is of a second hue with a substantially uniform intensity along the light-emitting surface of the scattering member.

10. The illumination device as recited in claim 1, wherein said scattering member is composed of a material that includes one or more light-fluorescing dyes, such that the substantially uniform light pattern perceived along the light-emitting surface of said scattering member has a hue distinct from that of the light source.

11. An illumination device, comprising:

a housing, including a base portion and a side wall, which defines an interior cavity with an open end having a predetermined shape;

a light source positioned within said interior cavity;

an electric connecting member also positioned within said interior cavity and adapted to connect said light source to a remote power source; and a scattering member positioned adjacent said light source at the open end of said interior cavity, said scattering member having substantially the same predetermined shape as the open end of said housing, and said scattering member having a light-emitting surface and being composed of a polyurethane compound impregnated with malloons, which causes light entering said scattering member to be directed through a portion of said scattering member and then scattered and emitted, such that a substantially uniform light pattern is perceived along the light-emitting surface of said scattering member in said predetermined shape.

12. The illumination device as recited in claim 11, wherein said light source is a plurality of light-emitting diodes.

* * * * *